United States Patent [19]

Pelavin

[11] 4,134,280

[45] Jan. 16, 1979

[54] LOCK COVER

[75] Inventors: Joseph Y. Pelavin, North Bergen, N.J.; Bela G. Szabo, Carnegie, Pa.

[73] Assignee: Lark Luggage Corporation, New York, N.Y.

[21] Appl. No.: 778,522

[22] Filed: Mar. 17, 1977

[51] Int. Cl.[2] ..... E05B 67/38

[52] U.S. Cl. ..... 70/55; 150/52 R

[58] Field of Search ..... 70/51, 52, 54, 55, 56, 70/455; 292/DIG. 73; 150/52 R, 0.5

[56] References Cited

U.S. PATENT DOCUMENTS

| | | | |
|---|---|---|---|
| 1,662,612 | 3/1928 | Junkunc | 70/55 |
| 3,848,440 | 11/1974 | Manuel | 70/55 |
| 3,952,560 | 4/1976 | Lee | 70/54 |

*Primary Examiner*—Robert L. Wolfe

*Attorney, Agent, or Firm*—Blum, Moscovitz, Friedman & Kaplan

[57] ABSTRACT

A lock and cover therefor. The lock has a laterally extending rib on its forward face which wraps around to join a pair of lengthwise ribs extending down each side wall of the lock, forming a T-shaped configuration at each side wall. The cover is constructed from flexible, resilient material which substantially surrounds the forward, rearward, side, and bottom walls of the lock. The inner forward panel of the cover has a laterally extending channel which wraps around to join a pair of lengthwise channels extending downwardly along each inner side panel of the cover for mating with the ribs on the lock. The cover also includes a lengthwise channel on an inner surface thereof extending from an edge of said cover for permitting insertion of a key and retention thereof.

9 Claims, 6 Drawing Figures

LOCK COVER

BACKGROUND OF THE INVENTION

This invention relates generally to a lock and cover therefor, and especially to padlocks and covers therefor. A variety of padlock configurations are known in the art. However, such padlocks are generally constructed from metal and may be very noisy when used in applications in which the item to be locked is movable, such as an article of luggate. Also, metallic locks, when used in such applications, may have a tendency to tear fabric or clothing. The instant invention avoids the foregoing disadvantages by providing a lock having a resilient cover, while offering other advantages.

SUMMARY OF THE INVENTION

Generally speaking, in accordance with the invention, a lock and resilient cover therefor are provided. The lock has a laterally extending rib on its forward face which wraps around to join a pair of lengthwise ribs extending down each side wall of the lock, forming a T-shaped configuration at each side wall. The cover is constructed from flexible, resilient material which substantially surrounds the forward, rearward, side and bottom walls of the lock. The inner surface of the forward panel of the cover has a laterally extending channel which wraps around to join a pair of lengthwise channels extending downwardly along the inner surface of each side panel of the cover for mating with the ribs on the lock. The cover also includes a lengthwise extending channel on the inner surface thereof and extending from an edge thereof for permitting insertion and retention of the key.

Accordingly, it is an object of this invention to provide an improved lock and cover therefor that renders the lock less noisy.

Another object of this invention is to provide an improved lock and cover therefor that protect the lock from shock.

A further object of this invention is to provide an improved lock and cover therefor which will not tear fabrics.

Still a further object of this invention is to provide an improved lock and cover therefor that improves the appearance of the lock.

Still another object of this invention is to provide a cover for a lock that is releasably securable in place Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompany drawings, in which.

DETAILED DESCRIPTION OF THE PREFERRED EMBODIMENTS

Figure 1:
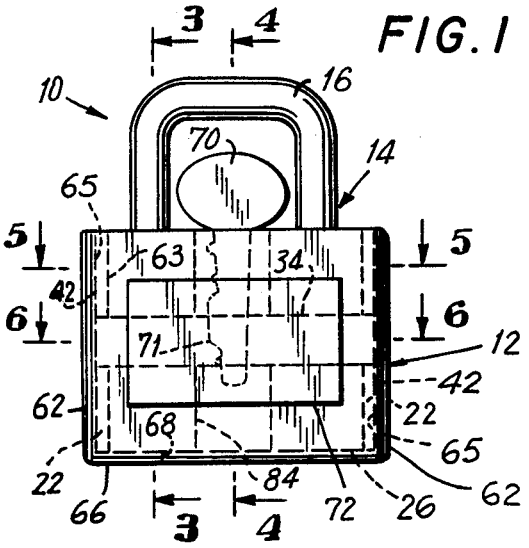
FIG. 1 is a front elevational view of a lock and cover therefor constructed in accordance with a preferred embodiment of the instant invention with a key stored in the channel provided therefor.
Figure 3:
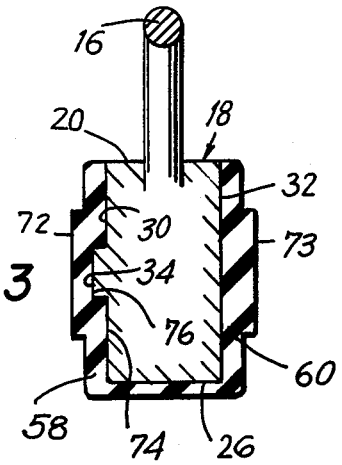
FIGS. 3, 4, 5 and 6 are sectional views taken along lines 3—3, 4—4, 5—5 and 6—6 of FIG. 1, respectively, with the key omitted.
Figure 2:
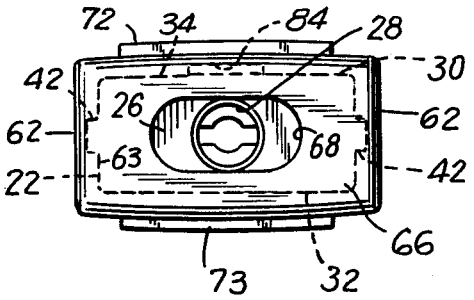
FIG. 2 is a bottom plan view of the lock and cover therefor of FIG. 1.
Figure 4:
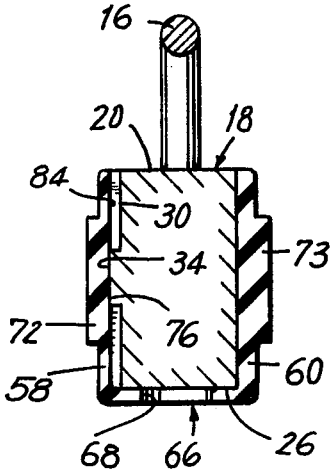
Figure 5:
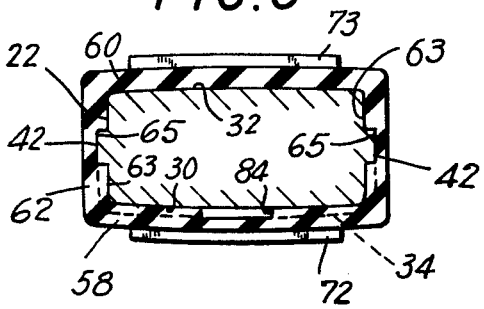
Figure 6:
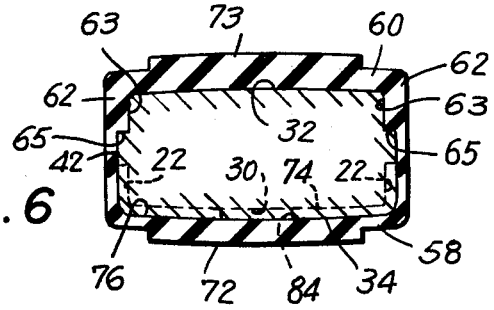

Referring now to the drawings, a lock and cover therefor 10 includes a cover 12 and a lock 14 which has a U-shaped loop portion 16 hingedly mounted on a body portion 18 and, for lengthwise displacement related to said body portion in a conventional manner. Body portion 18 includes a top surface 20 through which loop 16 extends, side walls 22, bottom surface 26 including keyhole 28, forward wall 30 and rearward wall 32.

Forward wall 30 has a rib 34 which extends laterally across the entire face of forward wall 30 and wraps around each side wall 22 to join a pair of narrower lengthwise ribs 42 which extend medially down each side wall 22. The intersection of ribs 42 with rib 34 forms a T-shaped rib configuration at each side wall 22. Rib 34 extends medially between top surface 20 and bottom surface 26 and is of substantially rectangular cross-section. Similarly, ribs 42 of side walls 22 are also substantially rectangular in cross-section.

Cover 12 is constructed from a flexible and resilient material, such as rubber, as a single unitary member. Cover 12 includes forward panel 58, rearward panel 60, side panels 62 and bottom panel 66 having an elongated opening 68 to permit the insertion, turning and removal of a key 70 in a keyhole 28. Forward panel 58 of cover 12 has a forwardly projecting thickened portion 72 which has a rectangular periphery and is suitable for use as a display panel for a trademark or the like. Rearward panel 60 includes a rearwardly projecting thickened portion 73 corresponding to thickened portion 72 of forward panel 58.

The inner face 74 of forward panel 58 is formed with a laterally extending channel 76 dimensioned to correspond to rib 34 of forward wall 30 of lock body 18. Channel 76 wraps around the inner faces 63 of side panels 62 to join the lengthwise channels 65 extending medially down side panels 62 which forms a T-shaped channel configuration on inner faces 63 of side panels 62 of cover 12 corresponding to the T-shaped rib configuration on each side wall 22 of lock body 18. Channels 76 and 65 are of substantially rectangular cross-section. Inner face 74 also includes a lengthwise channel 84 crossing channel 76 perpendicularly at its midpoint and also of substantially rectangular cross-sectional midpoint. As more particularly shown in FIG. 1, channel 84 is dimensioned to receive and retain the forward portion 71 of key 70 for temporary storage if desired. The flexibility of cover 12 permits the insertion of the key past rib 34, if desired.

The flexibility of cover 12 allows it to be easily placed on and removed from lock body 18. The engagement of the ribs 34 and 42 located on lock body 18 with the channels 76 and 65 in lock cover 12 provide a secure engagement of cover 12 to lock body 18. It is to be noted, that the ribs could be provided on cover 12 and the channels in body 18 and that channel 84 would be provided in either lock body 18 or cover 12 without departing from the spirit and scope of the instant invention.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A lock and cover therefor comprising a lock body, a cover for said lock body, said cover covering at least a portion of said lock body and means for releasably retaining said cover to said lock body, said lock body comprising forward and rearward walls, top and bottom walls, side walls, and said cover including forward, rearward and side panels covering at least a portion of each of said forward, rearward and side walls, one of said lock body and lock cover being formed with at least one lengthwise rib on at least one of the side walls or side panels thereof and at least one laterally extending rib on at least one of the forward and rearward walls or forward and rearward panels and lock cover being formed with corresponding channels in the respective sides or panels thereof positioned and dimensioned to mate with the corresponding ribs.

2. A lock and cover therefor as claimed in claim 1, wherein said at least one laterally extending rib on said at least one of said forward and rearward walls or panels is extended so as to abut said at least one lengthwise rib on said at least one of said side walls or panels to form a T-shaped configuration, the corresponding channels being likewise extended to form a corresponding configuration.

3. A lock and cover therefor as claimed in claim 1, said lock body having keyhole means in the bottom wall, said cover having a bottom panel covering at least a portion of said bottom wall and having an opening therethrough providing access to said keyhole means.

4. A lock and cover therefor as claimed in claim 1, wherein said cover is constructed from flexible and resilient material.

5. A lock and cover therefor comprising a lock body, a cover for said lock body, said cover covering at least a portion of said lock body and means for releasably retaining said cover to said lock body, one of said lock cover and lock body being formed with a lengthwise extending channel extending from an edge thereof in a surface thereof facing the other said channel being dimensioned to receive and retain between said lock cover and said lock body at least a portion of a key.

6. A lock cover comprising a forward panel, a rearward panel, side panels, a bottom panel having an opening therein for access to a key hole in said lock, said panel being shaped to cover and engage the corresponding walls of the body of a lock, and means for releasably securing said cover to said lock body, said securing means comprising channels formed in the inner faces of the panels of said cover for engagement with corresponding ribs on said lock body, said channels including at least one disposed lengthwise along the inner face of at least one of said side panels.

7. A cover for a lock as claimed in claim 6, wherein said channels include a laterally extending channel extending along the inner face of at least one of said forward and rearward panels.

8. A cover for a lock as claimed in claim 7, further including a lengthwise channel extending transversely to said laterally extending channel and communicating with an edge of said cover, said further channel being dimensioned to receive and retain a key in cooperation with said lock body.

9. A lock cover as claimed in claim 6, including a channel extending laterally along the inner face of at least one of said forward and rearward panels and extending so as to communicate with said at least one lengthwise channel on at least one of said side panels to form a T-shaped configuration.

* * * * *